US007189502B1

(12) United States Patent
Dickerson et al.

(10) Patent No.: US 7,189,502 B1
(45) Date of Patent: Mar. 13, 2007

(54) RADIOGRAPHIC MATERIALS WITH ANTIFOGGANT PRECURSORS

(75) Inventors: Robert E. Dickerson, Hamlin, NY (US); George J. Burgmaier, Pittsford, NY (US); Steven P. Szatynski, Rochester, NY (US); Stephen A. Hershey, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/242,340

(22) Filed: Oct. 3, 2005

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/06*** | (2006.01) |
| ***G03C 1/005*** | (2006.01) |

(52) U.S. Cl. ..... 430/551; 430/570; 430/567; 430/598; 430/955; 430/600; 430/603; 430/611; 430/613; 430/617

(58) Field of Classification Search ..... 430/551, 430/598, 570, 955, 600, 603, 611, 613, 617
See application file for complete search history.

(56) References Cited

U.S. PATENT DOCUMENTS

| | | | | |
|---|---|---|---|---|
| 3,364,028 | A | | 1/1968 | von König |
| 3,575,699 | A | | 4/1971 | Bloom et al. |
| 3,649,267 | A | | 3/1972 | Carlson et al. |
| 3,893,859 | A | | 7/1975 | Burness et al. |
| 4,255,510 | A | | 3/1981 | Simons et al. |
| 4,256,881 | A | | 3/1981 | Simons et al. |
| 4,442,290 | A | | 4/1984 | Bartels-Keith et al. |
| 4,554,243 | A | | 11/1985 | Ono et al. |
| 4,629,683 | A | * | 12/1986 | Itoh et al. ..... 430/390 |
| 4,888,268 | A | | 12/1989 | Itoh et al. |
| 6,440,655 | B1 | | 8/2002 | Szatynski et al. |
| 6,472,133 | B1 | | 10/2002 | Reynolds et al. |
| 6,472,134 | B1 | | 10/2002 | Szatynski et al. |
| 6,472,135 | B1 | | 10/2002 | Szatynski et al. |

* cited by examiner

*Primary Examiner*—Geraldina Visconti
(74) *Attorney, Agent, or Firm*—J. Lanny Tucker

(57) ABSTRACT

A radiographic material containing tabular silver halide grains also includes an amido compound as an antifoggant precursor that can slowly release an antifoggant over time. These compounds are present in reactive association with the silver halide in tabular silver halide emulsion layers, and are present in an amount of at least 0.5 mmol/mol of silver. The radiographic materials are protected from fog during storage particularly in high temperature environments.

24 Claims, No Drawings

RADIOGRAPHIC MATERIALS WITH ANTIFOGGANT PRECURSORS

FIELD OF THE INVENTION

This invention is directed to radiography. In particular, it is directed to radiographic materials that include certain amido compounds as antifoggant precursors.

BACKGROUND OF THE INVENTION

In conventional medical diagnostic imaging, the object is to obtain an image of a patient's internal anatomy with as little X-radiation exposure as possible. The fastest imaging speeds are realized by mounting a duplitized radiographic element between a pair of fluorescent intensifying screens for imagewise exposure. About 5% or less of the exposing X-radiation passing through the patient is adsorbed directly by the latent image forming silver halide emulsion layers within the duplitized radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

PROBLEM TO BE SOLVED

Radiographic films can include a variety of silver halide grains that are spectrally sensitized to certain wavelengths for particular imaging needs. For the last twenty years, tabular silver halide grains have become prominent in radiographic films because of their relatively higher surface area that enables significant capture of exposing light.

However, radiographic films containing tabular grains have exhibited a problem of increasing fog ($D_{min}$) upon storage, especially in high temperature and humidity environments. Part of the explanation for this problem may be that the higher surface area of the tabular silver halide grains makes them more sensitive to cosmic and other background radiation sources that will increase fog over time. In addition, higher storage temperatures may cause chemical sensitization to continue long after the radiographic films have been manufactured.

This "natural age keeping" ("NAK") problem is particularly noticeable when the radiographic films contain tabular silver halide grains that are spectrally sensitized to the "blue" region of the electromagnetic spectrum, or when they contain conductive (antistatic) layers (overcoats) disposed over the silver halide emulsion layers. It would be an advance in the art to solve this problem and to provide radiographic films with improved natural age keeping.

SUMMARY OF THE INVENTION

This invention provides a black-and-white radiographic material comprising a support and disposed on at least one side of the surface, one or more hydrophilic colloid layers including a tabular grain silver halide emulsion layer containing predominantly spectrally sensitized tabular silver halide grains, the silver halide emulsion further comprising at least 0.5 mmol/mol of silver of an amido compound as an antifoggant precursor that is in reactive association with silver halide in at least one tabular grain silver halide emulsion layer.

In preferred embodiments, the radiographic material comprises a polymeric support that has first and second major surfaces, the radiographic material having disposed each of the first and second major support surfaces, the same hydrophilic colloid layers including a single tabular grain silver halide emulsion layer, the tabular grain silver halide emulsion layer comprising:

a) green-sensitized tabular silver halide grains that have an aspect ratio of from about 30 to about 40, an average ECD of from about 2.5 to about 3 μm, and an average thickness of from about 0.07 to about 0.09 μm, and comprise at least 95 mol % bromide and up to 5 mol % iodide, both based on total silver in the grains, or b) blue-sensitized tabular silver halide grains that have an aspect ratio of from about 25 to about 30, an average ECD of from about 3 to about 3.5 μm, and an average thickness of from about 0.11 to about 0.14 μm, and comprise at least 95 mol % bromide and up to 5 mol % iodide, both based on total silver in the grains, the material comprising a protective overcoat disposed over all of the hydrophilic colloid layers on both sides of the support, wherein each of the tabular grain silver halide emulsion layers comprises the amido compound at from about 0.5 to about 2 mmol/mol of total silver on each side of the support, the amino compound comprising one or more of the following compounds (D), (L), or (U) described below This invention also provides an imaging assembly comprising:

A) a radiographic material of this invention, and

B) a fluorescent intensifying screen or storage phosphor panel arranged on the imaging side of the radiographic material, the screen or panel comprising an inorganic phosphor capable of absorbing X-rays and emitting electromagnetic radiation having a wavelength greater than 300 nm, the inorganic phosphor being coated in admixture with a polymeric binder in a phosphor layer on a support.

This invention further provides a method of providing a black-and-white image comprising processing an exposed radiographic material of the invention to provide a black-and-white image. Exposure of the radiographic material can be accomplished using a single fluorescent intensifying screen. The resulting black-and-white images in the processed radiographic material can be used for a medical diagnosis.

The radiographic films of this invention exhibit improved natural age keeping particularly under higher temperatures even when they contain blue-sensitive tabular silver halide grains or conductive overcoats. This advantage has been achieved by including certain amido compounds as antifoggant precursors in the radiographic films. These antifoggant precursors are able to slowly release an antifoggant over time, thereby diminishing the increase in $D_{min}$ (fog) during storage.

DETAILED DESCRIPTION OF THE INVENTION

Definition of Terms:

Unless otherwise indicated, the terms "radiographic imaging assembly", "imaging assembly", and "radiographic material", refer to embodiments of the present invention.

The term "contrast" as herein employed refers to the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta \log_{10} E$ ($\log_{10} E_2 - \log_{10} E_1$), $E_1$ and $E_2$ being the exposure levels at the reference points (1) and (2).

"Gamma" is used to refer to the instantaneous rate of change of a density vs. log E sensitometric curve (or instantaneous contrast at any log E value).

In this application, "film speed" is in reference to the radiographic material of this invention. Film speed has been given a standard of "150" for a commercially available KODAK Min-R 2000 radiographic film that has been exposed for 1 second and processed according to the Service Bulletin 30 using a fluorescent intensifying screen containing a terbium activated gadolinium oxysulfide phosphor (such as Screen X noted below in the Example). Thus, if the $K_s$ value for a given system using a given radiographic film is 50% of that for a second film with the same screen and exposure and processing conditions, the first film is considered to have a speed 200% greater than that of the second film. This commercially available film as also been described as Film A in U.S. Pat. No. 6,037,112 (Dickerson).

The term "duplitized" is used to define a radiographic material having one or more silver halide emulsion layers disposed on both the front- and backsides of the support. The radiographic materials of the present invention are preferably but not necessarily "duplitized."

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques described for example in U.S. Pat. No. 4,425,425 (Abbott et al.).

The term "aspect ratio" is used to define the ratio of grain ECD to grain thickness.

The term "coefficient of variation" (COV) is defined as 100 times the standard deviation (a) of grain ECD divided by the mean grain ECD.

"Green" sensitivity or green sensitization refers to sensitivity in the radiographic materials in the range of from about 490 to about 560 nm.

"Blue" sensitivity or green sensitization refers to sensitivity in the radiographic materials in the range of from about 420 to about 480 nm The term "fluorescent intensifying screen" refers to a "prompt" emitting fluorescent intensifying screen that will emit light immediately upon exposure to radiation while "storage" fluorescent screen or storage phosphor panel can "store" the exposing X-radiation for emission at a later time when the screen or panel is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

Radiographic Materials

The blue-sensitive radiographic materials have a film speed of at least 100 and the green-sensitive radiographic materials have a film speed of at least 400. These radiographic materials include a support having disposed on one or both sides thereof, one or more photographic silver halide emulsion (hydrophilic colloid) layers and optionally one or more non-light sensitive hydrophilic colloid layer(s). Where there are multiple silver halide emulsion layers, their composition, thickness, and sensitometric properties can be the same or different. Preferably, there is a single silver halide emulsion layer on each side of the support.

In more preferred embodiments, the radiographic materials have a single silver halide emulsion layer on each side of the support and a protective overcoat (described below) over it and any other non-light sensitive layers. Thus, at least one non-light sensitive hydrophilic layer is most preferably included with the silver halide emulsion layer on each side of the support. This non-light sensitive layer may be an interlayer or overcoat, or both types of non-light sensitive layers can be present.

The silver halide emulsion layer(s) can include silver halide grains having any desirable morphology or comprise a mixture of two or more of such morphologies as long as tabular silver halide grains comprise at least 50% of the total grain projected area in the emulsion. The composition and methods of making such silver halide grains are well known in the art. Generally, the same or different tabular grain silver halide emulsion layers are on opposing sides of the support.

Preferably, tabular grains comprise at least 70%, and more preferably at least 90%, of the total grain projected area. The grain composition can vary among multiple silver halide emulsion layers, but preferably, the grain composition is essentially the same in all silver halide emulsion layers. These tabular silver halide grains generally comprise at least 50, preferably at least 90, and more preferably at least 95, mol % bromide, based on total silver in the particular emulsion layer. Such emulsions include silver halide grains composed of, for example, silver iodobromide, silver chlorobromide, silver iodochlorobromide, and silver chloroiodobromide. The iodide grain content is preferably up to 10 mol %, based on total silver in the emulsion layer. More preferably, the iodide grain content is up to 5 mol %, based on total silver in the emulsion layer. The amount of iodide can be different in the blue-sensitized tabular grains compared to the green-sensitized tabular grains. Mixtures of different tabular silver halide grains can be used in the silver halide emulsion layers.

The green-sensitized tabular silver halide grains used in the silver halide emulsion layers generally have as aspect ratio of 30 or more, preferably of 30 or more and up to 50, and more preferably from about 35 to about 40. The aspect ratio can be the same or different in multiple silver halide emulsion layers, but preferably, the aspect ratio is essentially the same in all layers.

In general, the green-sensitized tabular grains have an average grain diameter (ECD) of at least 2.5 μm, and preferably of from about 2.5 to about 3.5 μm. The average grain diameters can be the same or different in multiple silver halide emulsion layers. At least 100 non-overlapping tabular grains are measured to obtain the "average" ECD.

In addition, the green-sensitized tabular grains generally have an average thickness of from about 0.07 to about 0.1 μm and preferably from about 0.07 to about 0.09 μm. The average thickness can be the same or different but preferably it is essentially the same for multiple silver halide emulsion layers.

The blue-sensitized tabular silver halide grains used in the silver halide emulsion layers generally have as aspect ratio of 25 or more, preferably of 25 or more and up to 35, and more preferably from about 25 to about 30. The aspect ratio can be the same or different in multiple silver halide emulsion layers, but preferably, the aspect ratio is essentially the same in all layers.

In general, the blue-sensitized tabular grains have an average grain diameter (ECD) of at least 3 μm, and preferably of from about 3 to about 3.5 μm. The average grain diameters can be the same or different in multiple silver halide emulsion layers. At least 100 non-overlapping tabular grains are measured to obtain the "average" ECD.

In addition, the blue-sensitized tabular grains generally have an average thickness of from about 0.1 to about 0.15 μm and preferably from about 0.11 to about 0.14 μm. The average thickness can be the same or different but preferably it is essentially the same for multiple silver halide emulsion layers.

The procedures and equipment used to determine tabular grain size (and aspect ratio) are well known in the art. Tabular grain emulsions that have the desired composition and sizes are described in greater detail in the following patents, the disclosures of which are incorporated herein by reference in relation to the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

A variety of silver halide dopants can be used, individually and in combination, in one or more of the silver halide emulsion layers to improve contrast as well as other common sensitometric properties. A summary of conventional dopants is provided in *Research Disclosure*, Item 38957 [Section I Emulsion grains and their preparation, sub-section D, and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed by *Research Disclosure*, Item 38957 (Section III Emulsion washing).

Any of the silver halide emulsions can be chemically sensitized by any convenient conventional technique as illustrated by *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

The antifoggant precursors used in this invention are amido compounds. By the term "antifoggant precursor," we mean a substance that can be converted usually by a chemical reaction into an antifoggant. The "antifoggant precursor" will generally not exhibit antifogging activity unless and until a chemical reaction occurs that converts the "antifoggant precursor" to an active, antifogging development inhibitor or INH (as defined below). In the present invention, the chemical reaction that converts the precursor into an active antifogging development inhibitor is usually catalyzed by increased temperature and pH.

The amido compounds described herein are generally added to any formulation or layer where they are "in reactive association" with silver formed from imaging. By "reactive association", we mean that the amido compounds are contained in a silver halide emulsion layer or in a non-emulsion layer whereby they can interact with, or come into contact with, the silver forming the black-and-white image. Thus, they can be incorporated into interlayers or overcoats, but preferably, they are in one or more silver halide emulsion layers.

Combination of amido compounds can be used, and it is specifically contemplated that two or more amido compounds having different INH groups (defined below) can be used. Particularly useful may be combinations of amido compounds containing different mercaptotetrazole type INH groups (such as phenyl mercaptotetrazole type INH groups).

One or more of the amido compounds are present in the radiographic materials in an amount of at least 0.5 mmol/mol of total silver on each side of the support, and preferably from about 0.5 to about 4 mmol/mol of total silver, and more preferably in an amount of from about 0.5 to about 2 mmol/mol of total silver on each side of the support. The amounts can be the same or different on the two sides of duplitized radiographic materials. One skilled in the art would also know how to optimize the amount of a given amido compound so that the $D_{min}$ increase is minimized while there is minimal loss in photospeed.

In particular, useful amido compounds can be represented by the following Structure (I):

(I)

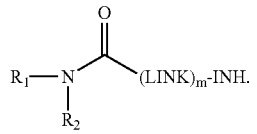

INH is a development inhibitor moiety. Examples of INH include but are not limited to compounds having a mercapto group bonded to a heterocyclic ring, such as substituted or unsubstituted mercaptoazoles [specifically 1-phenyl-5-mercaptotetrazole, 1-(4-carboxyphenyl)-5-mercaptotetrazole, 1-(3-hydroxyphenyl-5-mercaptotetrazole), 1-(4-sulfophenyl)-5-mercaptotetrazole, 1-(4-sulfamoylphenyl)-5-mercaptotetrazole, 1-(3-hexanoyl aminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,3,4-thiadiazole, 2-(2-dimethyaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxoazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-(3-(3-methylureido) phenyl)-5-mercaptotetrazole, 1-(4-nitrophenyl)-5-mercaptotetrazole, and 1-butyl-5-mercaptotetrazole], substituted or unsubstituted mercaptoazaindenes (specifically 6-methyl-4-mercapto-1,3,3a,7-tetraazaindene, 6-methyl-2-benzyl-4-mercapto-1,3,3a-7-tetraazaindene, 6-phenyl-4-mercaptotetraazaindene, and 4,6-dimethyl-2-mercapto-1,3,3a,7-tetraazaindene), and substituted or unsubstituted mercaptopyrimidines (specifically 2-mercaptopyrimidine, 2-mercapto-4-methyl-6-hydroxypyrimidine, and 2-mercapto-4-propylpyrimidine).

INH may also be a substituted or unsubstituted benzotriazole [specifically benzotriazole, 5-nitrobenzotriazole, 5-methylbenzotriazole, 5,6-dichlorobenzotriazole, 5-bromobenzotriazole, 5-methoxybenzotriazole, 5-(carboxyphenyl)-benzotriazole, 5-n-butylbenzotriazole, 5-nitro-6-cholorbenzotriazole, 5,6-dimethylbenzotriazole, 4,5,6,7-tetrachlorobenzotriazole, and 4,5,6,7-tetrabromobenzotriazole], substituted or unsubstituted indazoles (specifically indazole, 5-nitroindazole, 3-cyanoindazole, 3-chloro-5-nitroindazole, and 3-nitroindazole), and substituted or unsubstituted benzimidazoles (specifically 5-nitrobenzimidazole, 4-nitrobenzimidazole, 5,6-dichlorobenzimidazole, 5-cyano-6-chlorobenzimidazole, and 5-trifluoromethyl-6-chlorobenzimidazole). Preferably INH is a mercaptotetrazole, and most preferably INH is a substituted phenyl mercaptotetrazole.

$R_1$ and $R_2$ can independently be any substituents that are suitable for use in a silver halide radiographic material and that do not interfere with the stabilizing activity of the amido compound. $R_1$ and $R_2$ may independently represent a substituted or unsubstituted aliphatic, aromatic or heterocyclic group, or $R^1$ and $R^2$ together with the nitrogen to which they are attached can represent the atoms necessary to form a substituted or unsubstituted 5- or 6-membered ring or multiple ring system. Alternatively, $R_1$ and $R_2$ may independently be a —C(═O)$(LINK)_m$-INH group. Also, $R_1$ and $R_2$ may independently be substituted with an —$NR^{3a}$C(═O)-$(LINK)_m$-INH group, with $R_1$ or $R_2$ forming a bridge between two or more inhibitor releasing groups. $R^{3a}$ is defined the same as $R_1$ and $R_2$. This allows the amido compound to release more than one inhibitor moiety.

When $R_1$ and $R_2$ are aliphatic groups, preferably, they are alkyl groups having 1 to 22 carbon atoms, or alkenyl or alkynyl groups having 2 to 22 carbon atoms. These groups may or may not have substituents and include methyl, ethyl, propyl, n-butyl, n-pentyl, hexyl, octyl, 2-ethylhexyl, decyl, dodecyl, hexadecyl, octadecyl, cyclohexyl, isopropyl and t-butyl groups. Examples of alkenyl groups include allyl and n-butenyl groups and examples of alkynyl groups include propargyl and n-butynyl groups.

The preferred aromatic groups are carbocyclic aryl groups having 6 to 20 carbon atoms. More preferably, the aromatic groups have 6 to 10 carbon atoms and include, among others, phenyl and naphthyl groups. These groups may or may not have substituent groups. The heterocyclic groups are substituted or unsubstituted 3- to 15-membered rings with at least one atom selected from nitrogen, oxygen, sulfur, selenium, and tellurium in the ring. More preferably, the heterocyclic groups are 5- to 6-membered rings with at least one nitrogen atom in the ring. Examples of such heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole rings.

$R_1$ and $R_2$ may together form a substituted or unsubstituted single or multi-ring system. The ring systems formed by $R_1$ and $R_2$ may be alicyclic, aromatic, or heterocyclic as defined above.

Non-limiting examples of substituent groups for INH, $R_1$ and $R_2$ include branched or linear alkyl groups (for example, methyl, ethyl, and hexyl), branched or linear alkoxy groups (for example, methoxy, ethoxy, and octyloxy), aryl groups (for example, phenyl, naphthyl, and tolyl), hydroxy groups, halogen atoms, aryloxy groups (for example, phenoxy), branched or linear alkylthio groups (for example, methylthio and butylthio), arylthio groups (for example, phenylthio), acyl groups (for example, acetyl, propionyl, butyryl, and valeryl), sulfonyl groups (for example, methylsulfonyl and phenylsulfonyl), acylamino groups, sulfonylamino groups, acyloxy groups (for example, acetoxy and benzoxy), carboxyl groups, cyano groups, sulfo groups, and amino groups. Preferred substituents are lower alkyl groups having 1 to 4 carbon atoms (for example, methyl) and halogen groups (for example, chloro). INH may also be substituted with a —C(═O)$NR_3R_4$-INH group wherein $R_3$ and $R_4$ are independently hydrogen or lower alkyl groups.

In Structure I, m is 0, 1 or 2 and preferably, m is 0.

LINK may be any linking or timing group that does not interfere with the function of the amido compound, although it may modify the rate of release of the inhibitor from the amido compound, and that is suitable for use in a radiographic film system. Many such linking groups are known to those skilled in the art and some are known as timing groups. They include: (1) groups utilizing an aromatic nucleophilic substitution reaction [U.S. Pat. No. 5,262,291 (Slusarek et al.)], (2) groups utilizing the cleavage reaction of a hemiacetal [U.S. Pat. No. 4,146,396 (Yokota et al.) and Japanese Kokais 60-249148 and 60-249149], (3) groups utilizing an electron transfer reaction along a conjugated system [U.S. Pat. No. 4,409,323 (Sato et al.) and U.S. Pat. No. 4,421,845 (Uemura et al.) and Japanese Kokais 57-188035, 58-98728, 58-209736, and 58-209738], and (4) groups using an intramolecular nucleophilic substitution reaction (U.S. Pat. No. 4,248,962 (Lau)]. All of these references are incorporated by reference with respect to the LINK groups.

Illustrative timing groups are illustrated by formulae T-1 through T-4:

$$\text{-Nu-}(LINK_3)_a\text{-E-} \qquad \text{(T-1)}$$

wherein Nu is a nucleophilic group, E is an electrophilic group comprising one or more carbo- or hetero-aromatic rings, containing an electron deficient carbon atom, $LINK_3$ is a linking group that provides 1 to 5 atoms in the direct path between the nucleophilic site of Nu and the electron deficient carbon atom in E, and a is 0 or 1.

Such timing groups include, for example:

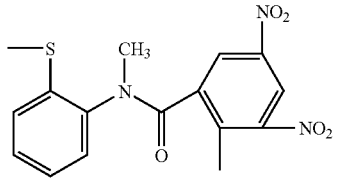

and

-continued

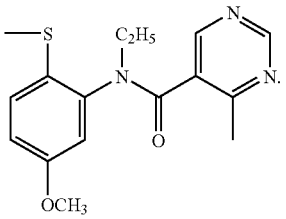

Also useful as a timing group is

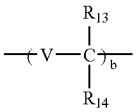

(T-2)

wherein V represents an oxygen atom, a sulfur atom, or an —$NR_{15}$— group, $R_{13}$ and $R_{14}$ independently represent hydrogen atoms or substituent groups, $R_{15}$ represents a substituent group, and b represents 1 or 2.

Typical examples of $R_{13}$ and $R_{14}$, when they represent substituent groups, and $R_{15}$ can include a —$R_{16}$, —$COR_{17}$, —$SO_2R_{17}$, —$CON(R_{16})R_{17}$, or —$SO_2N(R_{16})R_{17}$ group wherein $R_{16}$ represents an aliphatic or aromatic hydrocarbon residue, or a heterocyclic group, and $R_{17}$ represents a hydrogen atom, an aliphatic or aromatic hydrocarbon residue, or a heterocyclic group, $R_{13}$, $R_{14}$ and $R_{15}$ independently represent divalent groups, and any two of them can be combined with each other to complete a ring structure. Specific examples of the group represented by formula (T-2) are illustrated as follows:

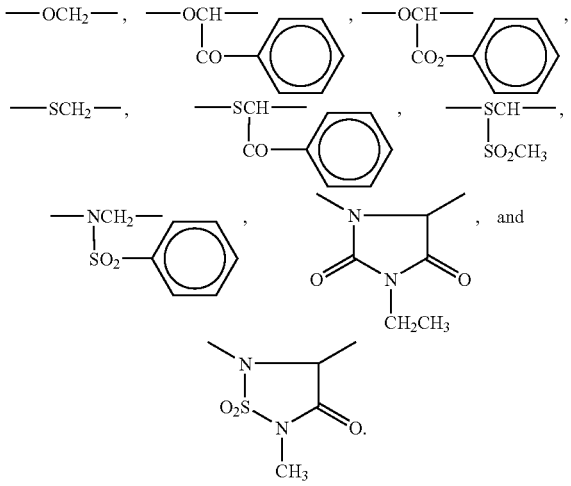

Another useful timing group is

-Nu1-$LINK_4$-E1 (T-3)

wherein Nu1 represents a nucleophilic group (such as an oxygen or sulfur atom), E1 represents an electrophilic group that is subjected to nucleophilic attack by Nu1, and $LINK_4$ represents a linking group that enables Nu1 and E1 to have a steric arrangement such that an intramolecular nucleophilic substitution reaction can occur. Specific examples of the group represented by formula (T-3) are illustrated as follows:

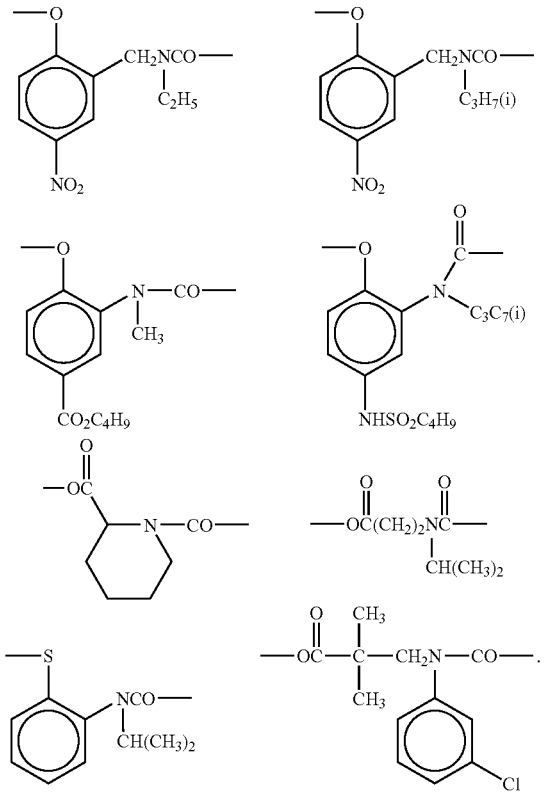

Still another useful timing group is

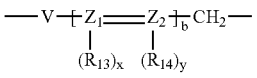

(T-4)

wherein V, $R_{13}$, $R_{14}$, and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ independently represent a carbon or nitrogen atom, and x and y independently represent 0 or 1.

Specific examples of the timing group (T-4) are illustrated as follows:

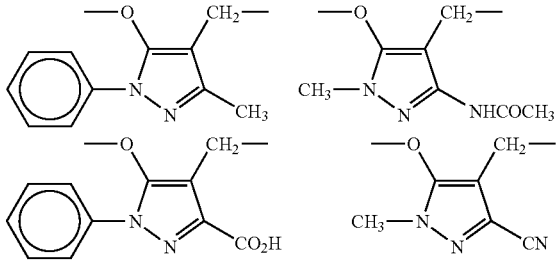

-continued

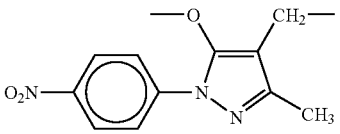

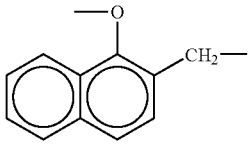

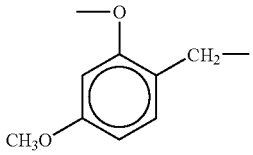

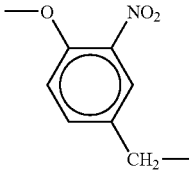

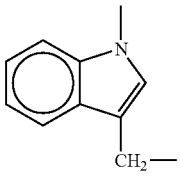

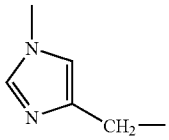

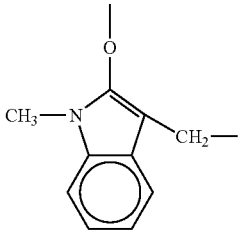

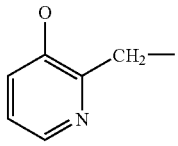

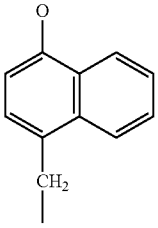

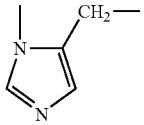

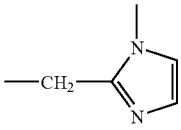

-continued

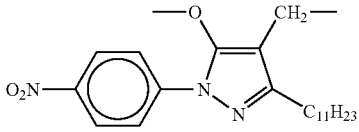

In one embodiment of the invention, LINK has the following Structure IIa:

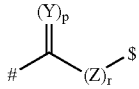

(IIa)

wherein X represents carbon or sulfur, Y represents oxygen, sulfur, or N—$R_5$, wherein $R_5$ is a substituted or unsubstituted alkyl or substituted or unsubstituted aryl group, p is 1 or 2, Z represents carbon, oxygen or sulfur, and r is 0 or 1, with the proviso that when X is carbon, both p and r are 1, and when X is sulfur, Y is oxygen, p is 2, and r is 0, # denotes the bond to INH, and $ denotes the bond to —C(═O)$NR_3R_4$—.

Illustrative linking groups include, for example,

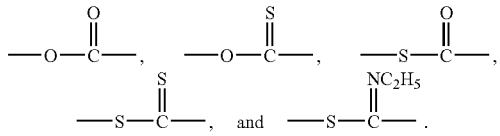

Some of the amido compounds useful in this invention include one or more solubilizing groups including but not limited to sulfo, carboxy, and sulfonamido groups. Sulfo groups are particularly useful. When anionic solubilizing groups are present, an appropriate number of counterions (cations) are also usually present. Such cations include but are not limited to, alkali metal ions (such as sodium and potassium ions) and ammonium ions including quaternary ammonium ions.

Non-limiting examples of the amido compounds useful in this invention include the following Compounds (A) through (V):

(A)

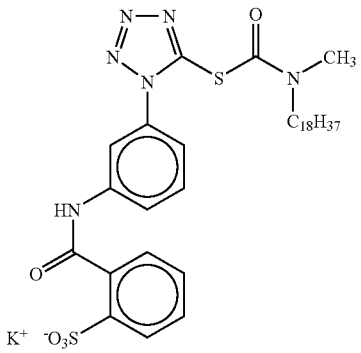

(B)

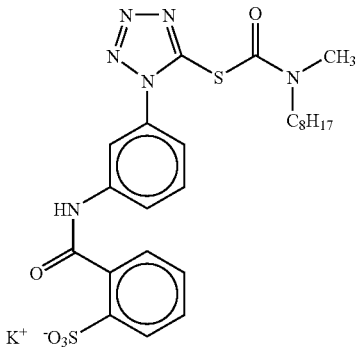

-continued
(C)
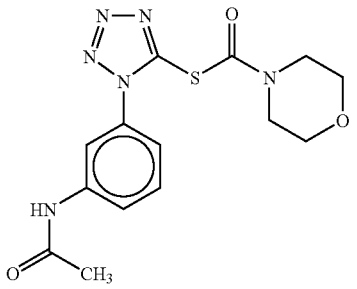
(D)
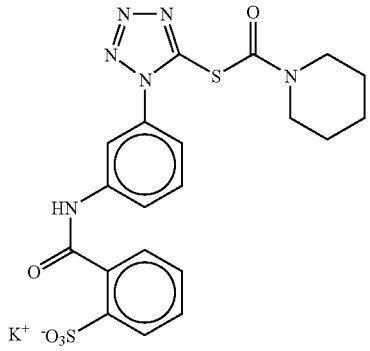
(E)
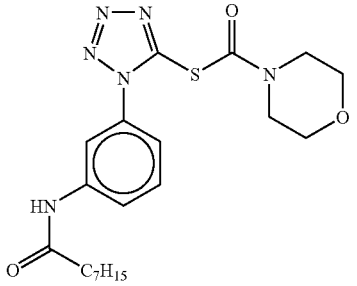
(F)
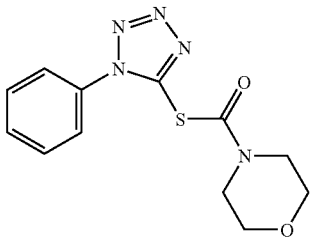
(G)
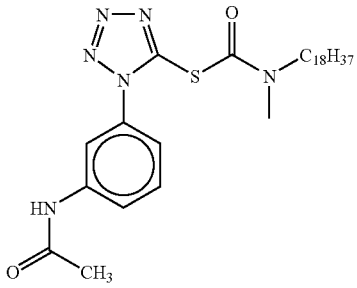
(H)
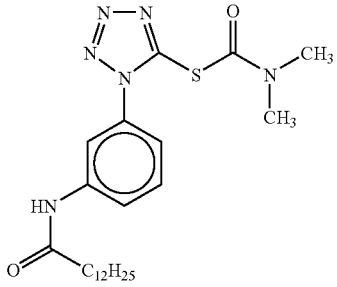
(I)
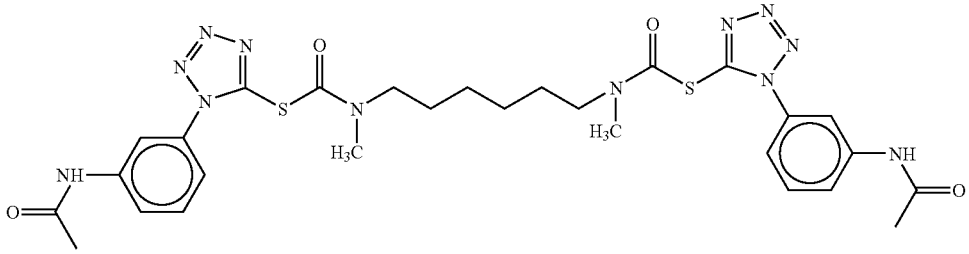
(J)
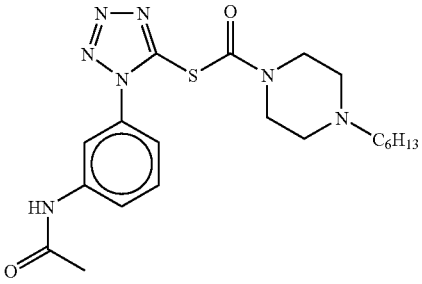
(K)
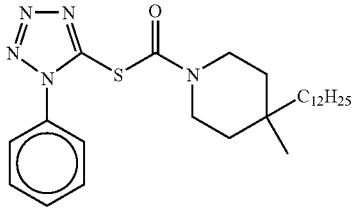

-continued
(L)
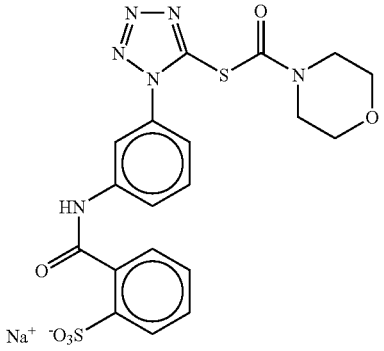
(M)
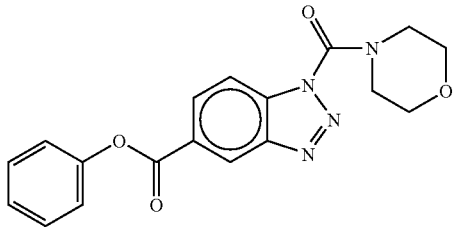
(N)
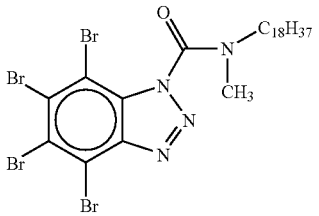
(O)
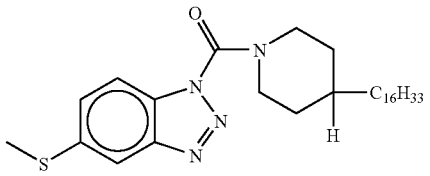
(P)
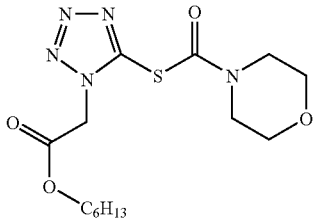
(Q)
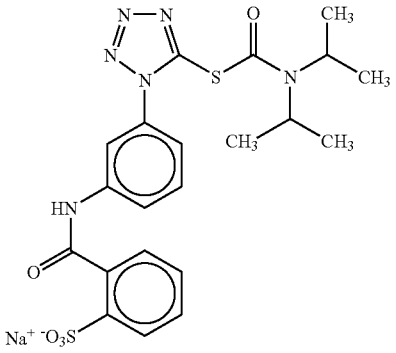
(R)
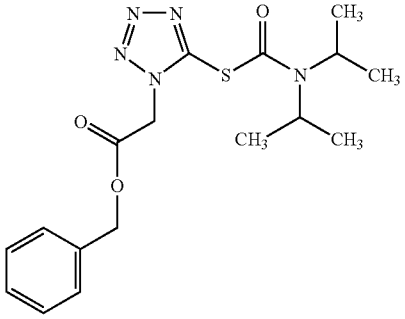
(S)
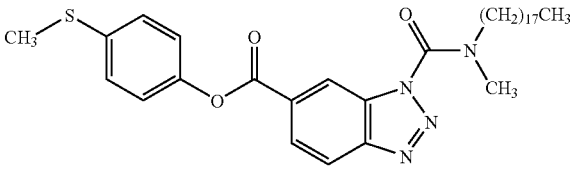

-continued (T)

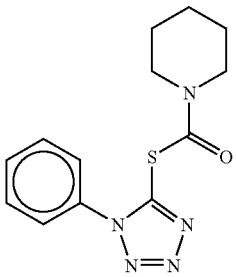

(U)

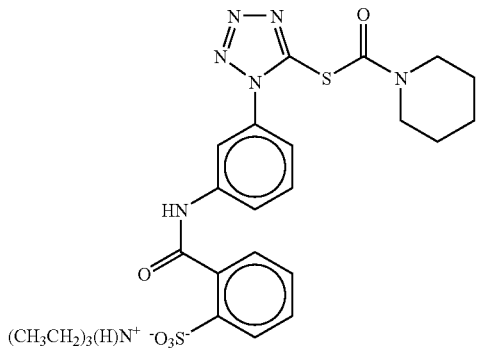

(V)

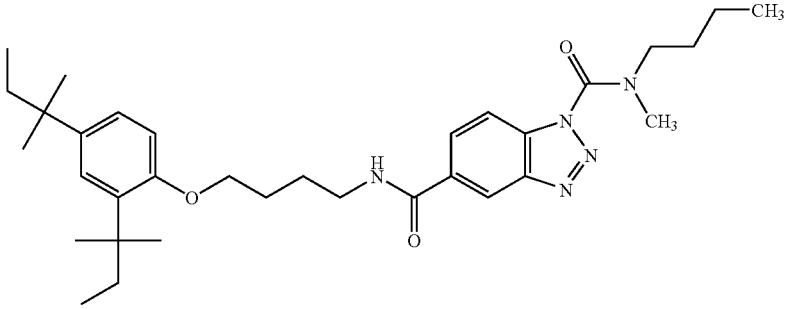

Compounds D, L, and U are preferred and Compound U is most preferred.

These compounds can be prepared using known starting materials and reaction conditions. A representative synthesis, for example of Compound G is provided in U.S. Pat. No. 6,472,133 (Reynolds et al.), incorporated herein for the synthesis only. Other compounds described herein can be similarly prepared.

The amido compounds can be incorporated into the tabular grain silver halide emulsion using any technique suitable for this purpose. They may be dissolved in common organic solvents such as methanol and acetone and added to the emulsion in the form of a solution or liquid dispersion, or as solid particle dispersions. The amido compounds can be added to the emulsion at any time during its preparation including during precipitation, during or before chemical sensitization, or during final melting and co-mixing of the emulsion with other additives. Preferably, the amido compounds are added after chemical sensitization and most preferably they are added to the emulsion melt formulation prior to coating.

The amido compounds may be utilized in addition to any conventional emulsion stabilizer or antifoggant as commonly practiced in the art.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver in the given emulsion layer. It is preferred that all of the silver halide grains used in the present invention (in all silver halide emulsion layers) be "green-sensitized" (spectrally sensitized to radiation of from about 470 to about 570 nm of the electromagnetic spectrum) or "blue-sensitized" (spectrally sensitized to radiation of from about 400 to about 530 nm). Various spectral sensitizing dyes are known for achieving this property. In some embodiments (for example, where the radiographic films comprise a conductive overcoat), green-sensitized tabular silver halide grains are preferred. In other embodiments, blue-sensitized tabular silver halide grains are preferred.

In some embodiments, it is preferred that the tabular silver halide grains be blue-sensitized using one or a combination of two different classes of spectral sensitizing dyes. Each of the first and second spectral sensitizing dyes has a J-aggregate absorption within the range of from about 380 to about 500 nm (preferably from about 410 to about 490 nm) when absorbed on the tabular silver halide grains. The two dyes typically have different maximum absorption and thus, one is generally "lower" than the other dye. This "lower" dye is termed herein the "first" spectral sensitizing dye and has a maximum J-aggregate absorption of from about 20 to about 50 nm lower than the maximum J-aggregate absorption of the second ("higher") spectral sensitizing dye.

Multiple spectral sensitizing dyes of each type can be used if desired. Thus, two or more first spectral sensitizing dyes can be used with one or more second spectral sensitizing dyes, and the converse is also true. Preferably, only one of each type of spectral sensitizing dye is used.

The molar ratio of the first spectral sensitizing dye to the second spectral sensitizing dye is from about 0.25:1 to about 1:1, and preferably it is from about 0.3:1 to about 0.8:1. The most preferred molar ratio is from about 0.4:1 to about 0.7:1. In addition, the combination of spectral sensitizing dyes is present in the silver halide emulsion containing the tabular silver halide grains in an amount sufficient to provide from about 50 to 100% (preferably from about 70 to about 80%) of saturation coverage of the tabular silver halide grains. For most of the useful blue-light sensitive spectral sensitizing dyes, this would amount to from about 400 to about 800 mg/mole, or from about 0.55 to about 1.1 mmol/mole, of total silver in the silver halide emulsion layer. The particular amount will vary with the surface area of the tabular grains used in the emulsion. Optimum amounts will vary with the particular dyes used and a skilled worker in the art would understand how to achieve optimal results with the combination of dyes in appropriate amounts. Obviously, the spectral sensitizing dyes may also be absorbed to any silver halide grains that are not tabular in morphology.

In general, the first spectral sensitizing dye is an anionic benzimidazole-benzoxazole simple cyanine having at least one sulfo or carboxy group in the molecule, and the second spectral sensitizing dye is an anionic benzothiazole—benzothiazole simple cyanine having at least one sulfo or carboxy group in the molecule. Preferably, each of the first and second spectral sensitizing dyes has at least two sulfo groups in the molecule.

More particularly, the first spectral sensitizing dye is a monomethine cyanine dye represented by the following Structure (II):

(II)

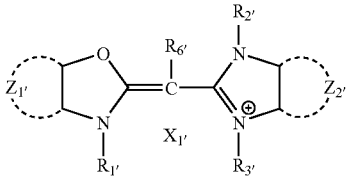

wherein $Z_1'$ and $Z_2'$ represent the carbon atoms necessary to form a substituted or unsubstituted benzene or naphthalene ring. Thus, the terms "benzothiazole", "benzoxazole", and "benzimidazole" used herein to define the spectral sensitizing dyes are intended to include compounds where $Z_1'$ and $Z_2'$ form naphthalene rings fused to the defined N-containing heterocyclic rings. Preferably, each of $Z_1'$ and $Z_2'$ independently represent the carbon atoms necessary to form a substituted or unsubstituted benzene ring.

In Structure II, $R_1'$, $R_2'$, and $R_3'$ are independently alkyl groups having 1 to 10 carbon atoms, alkoxy groups having 1 to 10 carbon atoms, aryl groups having 6 to 10 carbon atoms in the aromatic ring, alkenyl groups having 2 to 8 carbon atoms, and other substituents that would be readily apparent to one skilled in the art. Such groups can be substituted with one or more hydroxy, alkyl, carbonamido, carboxy, sulfo, halo, and alkoxy groups. Preferably, at least one of the $R_1'$, $R_2'$, and $R_3'$ groups comprises at least one sulfo or carboxy group.

More preferably, $R_1'$, $R_2'$, and $R_3'$ are independently alkyl groups having 1 to 4 carbon atoms, phenyl groups, alkoxy groups having 1 to 4 carbon atoms, or alkenyl groups having 2 to 4 carbon atoms. All of these groups can be substituted as described above, and in particular, they can be substituted with a sulfo group.

$R_6'$ is hydrogen, a substituted or unsubstituted alkyl group having 1 to 4 carbon atoms, or a phenyl group, each of which groups can be substituted as described above for the other radicals. Preferably, $R_6'$ is hydrogen, or a methyl or ethyl group.

In Structure II, $X_1'$ is a suitable anion or cation, as needed, to balance the charge of the dye molecule. Useful anions include, but are not limited to, halides, thiocyanate, sulfate, perchlorate, p-toluene sulfonate, ethyl sulfate, and other anions readily apparent to one skilled in the art. Suitable cations include, but are not limited to, alkali metal ions.

Particularly useful second spectral sensitizing dyes are monomethine cyanine dyes represented by the following Structure (III):

(III)

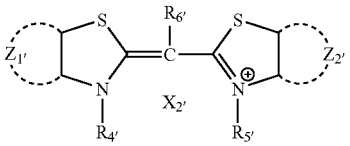

wherein $Z_1'$ and $Z_2'$ represent the carbon atoms necessary to form a substituted or unsubstituted benzene or naphthalene ring (as defined above for Structure II) and $R_4'$ and $R_5'$ are independently substituted or unsubstituted alkyl, alkoxy, aryl, or alkenyl groups as defined above for $R_1'$ through $R_3'$. $R_6'$ is as defined above for Structure II. $X_2'$ is a suitable anion or cation as defined above for $X_1'$.

Preferably, $R_4'$ and $R_5'$ are independently alkyl groups having 1 to 4 carbon atoms, phenyl groups, alkoxy groups having 1 to 4 carbon atoms, or alkenyl groups having 2 to 4 carbon atoms.

The spectral sensitizing dyes described herein can be prepared as described in U.S. Pat. No. 4,518,689 (Noguchi et al.) or by using known starting materials and synthetic procedures. Other details about such compounds are provided by Hamer, *The Cyanine Dyes and Related Compounds*, Interscience, New York, 1964.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

It may also be desirable that the silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on the support of the radiographic materials generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions useful in the present invention will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, based upon U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Wilgus et al.), for example, teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (Kofron et al.) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions for use in the present invention, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight).

Thus may be useful that the coated tabular grain silver halide emulsion layers comprise tabular silver halide grains dispersed in a hydrophilic polymeric vehicle mixture comprising at least 0.05% and preferably at least 0.1% of oxidized gelatin based on the total dry weight of hydrophilic polymeric vehicle mixture in the coated emulsion layer. The upper limit for the oxidized gelatin is not critical but for practical purposes, it is 1.5% based on the total dry weight of the hydrophilic polymer vehicle mixture. Preferably, from about 0.1 to about 1.5% (by dry weight) of the hydrophilic polymer vehicle mixture is oxidized gelatin.

It is also preferred that the oxidized gelatin be in the form of deionized oxidized gelatin but non-deionized oxidized gelatin can be used, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 μmol of methionine, and more preferably from 0 to 1 μmol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic materials are generally fully hardened using one or more conventional hardeners. Thus, the amount of hardener on the one side of the support is generally at least 1% and preferably at least 1.5%, based on the total dry weight of the polymer vehicles.

The levels of silver and polymer vehicle in the radiographic material can vary in the various silver halide emulsion layers. In general, the total amount of silver on the imaging side of the support is at least 13 and no more than 20 mg/dm$^2$ (preferably from about 15 to about 18 mg/dm$^2$). In addition, the total coverage of polymer vehicle (all layers) on the imaging side of the support is generally at least 28 and no more than 40 mg/dm$^2$ (preferably from about 28 to about 34 mg/dm$^2$). These amounts refer to dry weights.

In some embodiments wherein the tabular silver halide grains are green-sensitized, the radiographic material has a total silver coverage of at least 15 and up to 18 mg/dm$^2$ on the tabular grain silver halide emulsion side of the support, and a polymer vehicle coverage on the tabular grain emulsion side of the support of from about 28 to about 34 mg/dm$^2$, or if the tabular silver halide grains are blue-sensitized, the radiographic material has a total silver coverage of at least 17 and up to 20 mg/dm on said tabular grain silver halide emulsion side of the support, and a polymer vehicle coverage on the tabular grain emulsion side of the support of from about 28 to about 34 mg/dm$^2$.

The radiographic materials generally include a surface protective overcoat disposed on the imaging side over the one or more tabular silver halide emulsion layers, which protective overcoat typically provides for physical protection of the various layers underneath. The protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are described in *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers.

In some embodiments, the protective overcoat is a conductive (or antistatic) protective overcoat containing one or more conductive materials or antistatic agents including conductive metal particles as described for example in U.S. Pat. No. 5,294,525 (Gun), U.S. Pat. No. 5,368,995 (Christian et al.), U.S. Pat. No. 5,382,494 (Kudo et al.), U.S. Pat. No. 5,459,021 (Ito et al.), U.S. Pat. No. 5,378,577 (Smith et al.), conductive polymers (such as thiophene-, aniline- and pyrrole-containing polymers) as described for example in U.S. Pat. No. 5,665,498 (Savage et al.), U.S. Pat. No. 5,674,654 (Zumbulyadis et al.), U.S. Pat. No. 5,300,575 (Jonas et al.), U.S. Pat. No. 5,312,681 (Muys et al.), U.S. Pat. No. 5,354,613 (Quintens et al.), U.S. Pat. No. 5,716,550 (Gardner et al.), U.S. Pat. No. 5,093,439 (Epstein et al.), and U.S. Pat. No. 4,070,189 (Kelley et al.), and conductive surfactants (including flurosurfactants) as described in U.S. Pat. No. 3,589,906 (McDowell), U.S. Pat. No. 3,666,478 (Groh et al.), U.S. Pat. No. 3,754,924 (DeGeest et al.), U.S. Pat. No. 3,775,236 (Ambrose), U.S. Pat. No. 3,850,642 (Bailey, Jr. et al.), U.S. Pat. No. 4,891,307 (Mukunoki et al.), and U.S. Pat. No. 5,368,894 (Lammers et al.). These conductive materials can be incorporated into the overcoat in amounts that are readily apparent to one skilled in the art.

For example, some radiographic materials comprise green-sensitized tabular silver halide grains and a protective overcoat that is a conductive protective overcoat comprising one or more antistatic agents.

The various coated layers of radiographic materials can also contain tinting dyes to modify the image tone to reflected light. These dyes are not decolorized during processing and may be homogeneously or heterogeneously dispersed in the various layers. Preferably, such non-bleachable tinting dyes are in one or more silver halide emulsion layers.

The support can take the form of any conventional radiographic film support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

Imaging Assemblies

A radiographic imaging assembly is composed of one radiographic material as described herein and at least one fluorescent intensifying screen arranged on the imaging side(s) of the radiographic material. The radiographic material and fluorescent intensifying screen can be arranged in a suitable "cassette" designed for this purpose. Fluorescent intensifying screens are typically designed to absorb X-rays and to promptly emit electromagnetic radiation having a wavelength greater than 300 nm. These screens can take any convenient form providing they meet all of the usual requirements for use in radiographic imaging. Examples of conventional, useful fluorescent intensifying screens and methods of making them are provided in *Research Disclosure*, Item 18431 (Section IX X-Ray Screens/Phosphors) and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains prompt-emitting phosphor particles dispersed in a suitable binder, and may also include a light scattering material, such as titania.

Any prompt-emitting phosphor can be used, singly or in mixtures, in the intensifying screens. The phosphors can be either blue-light or green-light emitting phosphors depending upon the spectral sensitivity of the tabular silver halide grains used in the radiographic materials.

Useful phosphors are described in numerous references relating to fluorescent intensifying screens, including but not limited to, *Research Disclosure*, Vol. 184, August 1979, Item 18431 (Section IX X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 4,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.), and EP 0 491,116A1 (Benzo et al.), the disclosures of all of which are incorporated herein by reference with respect to the phosphors.

The inorganic phosphor can be calcium tungstate, activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Alternatively, the inorganic phosphor is a rare earth oxychalcogenide and oxyhalide phosphors and represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Th), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides or oxysulfides (such as $Gd_2O_2S$:Tb).

Other suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting phosphors such as barium fluorobromide.

Another class of useful phosphors includes rare earth hosts such as rare earth activated mixed alkaline earth metal sulfates such as europium-activated barium strontium sulfate.

Other useful phosphors are alkaline earth metal phosphors that can be the products of firing starting materials comprising optional oxide or a combination of species as characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t" is from 0 to 0.01. These definitions apply wherever they are found in this application unless specifically stated to the contrary. It is also contemplated that "M", "X", "A", and "D" represent multiple elements in the groups identified above.

The phosphor can be dispersed in a suitable binder(s) in a phosphor layer. A particularly useful binder is a polyurethane binder such as that commercially available under the trademark Permuthane.

One preferred green-light emitting phosphor is a terbium activated gadolinium oxysulfide. Preferred blue-light emitting phosphors include calcium tungstate and barium fluorobromide. A skilled worker in the art would be able to choose the appropriate inorganic phosphor, its particle size, emission wavelength, and coverage in the phosphor layer for a given radiographic material.

Support materials for fluorescent intensifying screens and storage phosphor panels include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or the like. A flexible plastic film is preferably used as the support material.

In addition, the support can be a "microvoided support" as described in more detail in U.S. Pat. No. 6,836,606 (Laney et al.), incorporated herein by reference.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity screen. It is highly preferred that the support absorbs substantially all of the radiation emitted by the phosphor. Examples of preferred supports include polyethylene terephthalate, blue colored or black colored (for example, LUMIRROR C, type X30 supplied by Toray Industries, Tokyo, Japan). These supports may have a thickness that may differ depending o the material of the support, and may generally be between 60 and 1000 μm, more preferably between 80 and 500 μm from the standpoint of handling.

Imaging and Processing

Exposure and processing of the radiographic materials can be undertaken in any convenient conventional manner. The exposure and processing techniques of U.S. Pat. Nos. 5,021,327 and 5,576,156 (both noted above) are typical for processing radiographic materials. Exposing X-radiation is generally directed through a patient and then through fluorescent intensifying screens arranged against the frontside and backside of the radiographic material. The screens then emit suitable radiation in an imagewise fashion to provide the latent image in the radiographic material.

Processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multipart formulations, and in concentrated form or as more diluted working strength solutions.

It is particularly desirable that the radiographic materials of this invention be processed within 90 seconds ("dry-to-dry") and preferably for at least 20 seconds and up to 60 seconds ("dry-to-dry"), including the developing, fixing, any washing (or rinsing) steps, and drying. Such processing can be carried out in any suitable processing equipment including but not limited to, a Kodak X-OMAT® RA 480 processor that can utilize Kodak Rapid Access processing chemistry. Other "rapid access processors" are described for example in U.S. Pat. No. 3,545,971 (Barnes et al.) and EP 0 248,390A1 (Akio et al.).

Radiographic kits can include an imaging assembly, additional fluorescent intensifying screens and/or metal screens, one or more radiographic materials, and/or one or more suitable processing compositions.

The following examples are presented for illustration and the invention is not to be interpreted as limited thereby.

EXAMPLE 1

Blue-Sensitive Radiographic Material

The following blue-sensitive radiographic materials were prepared and evaluated:

Radiographic Material A (Control):

Radiographic Material A was a duplitized film having the same blue-light sensitive tabular grain silver halide emulsion layer on each side of a blue-tinted 170 μm transparent poly(ethylene terephthalate) film support and the same interlayer and overcoat layer over each emulsion layer. Each emulsion layer contained tabular silver iodobromide (0.015:0.985) grains that were prepared and dispersed in deionized oxidized gelatin that had been added at multiple times before and/or during the nucleation and early growth of the silver bromide tabular grains dispersed therein. The nucleation and early growth of the tabular grains were performed using a "bromide-ion-concentration free-fall" process in which a dilute silver nitrate solution was slowly added to a bromide ion-rich deionized oxidized gelatin environment. The iodide was added during growth as a 3.5 mol % vAg-controlling bromoiodide salt, starting at the beginning of growth (1.7% of silver run) to 85% of the silver run. The tabular grains had a mean aspect ratio of about 30. The resulting tabular grains were chemically sensitized with aurousdithiosulfate, sodium thiocyanate, and potassium selenocyanate using conventional procedures. Spectral sensitization to the "blue" region was provided using a 50:50 molar blend of spectral sensitizing dyes SS-1 and SS-2 identified below. The total amount of spectral sensitizing dyes was 500 mg per mole of silver.

(SS-1)

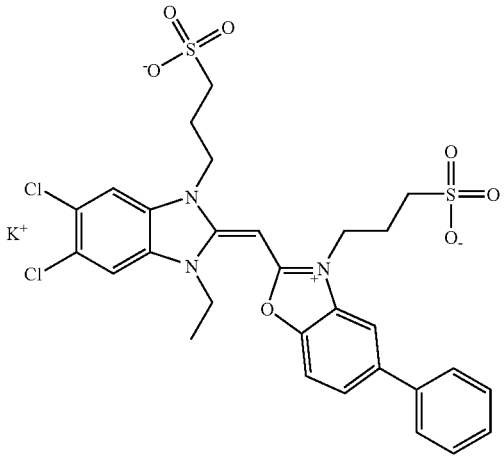

-continued (SS-2)

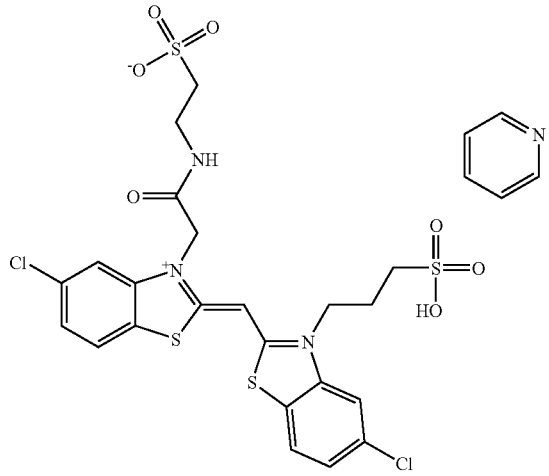

Radiographic Material A had the following layer arrangement:

Overcoat

Interlayer

Emulsion Layer

Support

Emulsion Layer

Interlayer

Overcoat

The noted layers were prepared from the following formulations.

| | Coverage (mg/dm$^2$) |
|---|---|
| Overcoat Formulation | |
| Gelatin vehicle | 2.2 |
| Methyl methacrylate matte beads | 0.27 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |
| Dow Corning polydimethylsiloxane | 0.035 |
| TRITON ® X-200E surfactant (Union Carbide) | 0.16 |
| Fluorad FC-124 surfactant (3M Company) | 0.38 |
| Forafac 1157 surfactant (3M Company) | 0.016 |
| Interlayer Formulation | |
| Gelatin vehicle | 2.9 |
| Carboxymethyl casein | 0.73 |
| Colloidal silica (LUDOX AM) | 1.07 |
| Polyacrylamide | 0.54 |
| Chrome alum | 0.025 |
| Resorcinol | 0.058 |
| Emulsion Layer Formulation | |
| 3-dimensional grain emulsion [AgIBr (1.5:98.5 mol ratio, 3.0 × 1.2 μm ave. dia. and thickness] | 18.7 |
| Gelatin vehicle | 20.5 |
| 4-Hydroxy-6-methyl-1,3,3a,7-tetraazaindene | 2.1 g/Ag mole |
| Nitroindazole | 7 g/Ag mole |
| Potassium nitrate | 3.81 |
| Sodium disulfocathecol | 4.69 g/Ag mole |
| Maleic acid hydrazide | 1.31 |
| Sorbitol | 1.26 |

-continued

| | Coverage (mg/dm$^2$) |
|---|---|
| Glycerin | 2.02 |
| Carboxymethylcasein | 1.62 |
| Polyacrylamide | 2.7 |
| Chrome alum | 13.3 g/Ag mole |
| Bisvinylsulfonylmethylether | 0.7% based on total gelatin in all layers |

Radiographic Material B (Invention)

Radiographic Material B was like Material A except that antifoggant precursor Compound U was added to the silver halide emulsion layer at 0.16 mg/dm$^2$ (or 1.5 mg/ft$^2$)

Radiographic Material C (Invention):

Material C was like Material A except that antifoggant precursor Compound U was added to the silver halide emulsion layer at 0.32 mg/dm$^2$ (or 3 mg/ft$^2$).

Samples of the radiographic materials A–C were exposed through a graduated density step tablet to a commercially available MacBeth sensitometer for $1/50^{th}$ second to a 50 watt General Electric DMX projector lamp calibrated to 2650°K, filtered with a Corning filter to simulate a blue-light emitting phosphor intensifying screen.

The exposed samples of Radiographic Materials A, B, and C were processed using a commercially available KODAK RP X-OMAT® Film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

Fixing was carried out using KODAK RP X-OMAT® LO Fixer and Replenisher fixing composition (Eastman Kodak Company). The samples were processed in the developer for less than 90 seconds and the total processing time was about 90 seconds ("dry-to-dry").

Optical densities are expressed below in terms of diffuse density as measured by a conventional X-rite Model 310™ densitometer that was calibrated to ANSI standard PH 2.19 and was traceable to a National Bureau of Standards calibration step tablet. The characteristic density vs. log E curve was plotted for each radiographic material that was exposed and processed as noted above. System speed was measured as noted above at a density of 1.0+$D_{min}$.

Imaged and processed film samples were also incubated in conditioned rooms at constant 49° C. and 50% R.H. for specific periods of time.

The following TABLE I shows the sensitometric data (photospeed and $D_{min}$) before incubation ("fresh") and during incubation periods Radiographic Films A–C. The data show that the films of the present invention containing the antifoggant precursor had less increase in $D_{min}$ during the incubation periods than the Control. The use of the antifoggant precursor, however, did reduce speed somewhat and this would have to be a consideration as one skilled in the art chooses the type of antifoggant compound and the amount to use so that the speed loss if not unacceptable.

TABLE I

| Radiographic Material | "Fresh" Speed | 1 Week Speed | 2 Week Speed | 3 Week Speed | 4 Week Speed |
|---|---|---|---|---|---|
| A (Control) | 488 | 490 | 492 | 493 | 495 |
| B (Invention) | 488 | 486 | 486 | 488 | 488 |
| C (Invention) | 487 | 484 | 483 | 484 | 485 |
| **Radiographic Material** | **"Fresh" $D_{min}$** | **1 Week $D_{min}$** | **2 Week $D_{min}$** | **3 Week $D_{min}$** | **4 Week $D_{min}$** |
| A (Control) | 0.201 | 0.215 | 0.245 | 0.272 | 0.292 |
| B (Invention) | 0.205 | 0.212 | 0.221 | 0.236 | 0.245 |
| C (Invention) | 0.209 | 0.209 | 0.215 | 0.227 | 0.235 |

EXAMPLE 2

Green-Sensitive Radiographic Materials

The following green-sensitive radiographic materials were prepared and evaluated similar to the blue-sensitive radiographic materials described in Example 1:

Radiographic Material D (Control):

Radiographic Material D was a duplitized film having the same green-light sensitive tabular grain silver halide emulsion layer on each side of a blue-tinted 170 μm transparent poly(ethylene terephthalate) film support and the same interlayer and conductive overcoat layer over each emulsion layer. Each emulsion layer contained high aspect ratio tabular silver bromide grains. The tabular grains had a mean aspect ratio of about 34. The resulting tabular grains were chemically sensitized with sodium thiosulfate, potassium selenocyanate, potassium tetrachloroaurate, and sodium thiocyanate using conventional procedures. Spectral sensitization to the "green" region was achieved using 680 mg of anhydro-5,5-dichloro-9-ethyl-3,3'-bis(3-sulforopyl)oxacarbocyanine hydroxide per mole of silver, followed by 400 mg of potassium iodide per mole of silver.

Radiographic Material D had the following layer arrangement:

Conductive Overcoat 1

Interlayer 1

Emulsion Layer

Support

Emulsion Layer

Interlayer 2

Conductive Overcoat 2

The noted layers were prepared from the following formulations.

| | Coverage (mg/dm$^2$) |
|---|---|
| Conductive Overcoat 1 Formulation | |
| Gelatin vehicle | 1.6 |
| Methyl methacrylate matte beads | 0.27 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |

-continued

| | Coverage (mg/dm$^2$) |
|---|---|
| Dow Corning polydimethylsiloxane | 0.064 |
| Olin Surfactant 10G | 0.91 |
| Fluorad FC-124 surfactant (3M Company) | 0.38 |
| Interlayer 1 Formulation | |
| Gelatin vehicle | 2.8 |
| AgI Lippmann emulsion (0.08 μm) | 0.11 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |
| 5-Nitroindazole | 0.038 |
| 4-Hydroxy-6-methyl-1,3,3a,7-tetraazaindene | 0.46 |
| Olin Surfactant 10G | 0.46 |
| Emulsion Layer Formulation | |
| 3-dimensional grain emulsion [AgBr (2.9 × 0.085 μm ave. dia. and thickness] | 16.1 |
| Gelatin vehicle | 26.3 |
| 4-Hydroxy-6-methyl-1,3,3a,7-tetraazaindene | 2.1 g/Ag mole |
| Potassium nitrate | 1.8 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethylether | 2.4% based on total gelatin in all layers |
| Interlayer 2 Formulation | |
| Gelatin vehicle | 2.8 |
| AgI Lippmann emulsion (0.08 μm) | 0.11 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |
| 5-Nitroindazole | 0.038 |
| 4-Hydroxy-6-methyl-1,3,3a,7-tetraazaindene | 0.46 |
| Conductive Overcoat 2 Formulation | |
| Gelatin vehicle | 2.54 |
| Methyl methacrylate matte beads | 0.27 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |
| Dow Corning polydimethylsiloxane | 0.064 |
| Zonyl ® FSN surfactant (DuPont) | 0.48 |
| Fluorad FC-124 surfactant (3M Company) | 0.38 |

Radiographic Material E (Invention)

Radiographic Material E was like Material D except that antifoggant precursor Compound U was added to the silver halide emulsion layer at 0.11 mg/dm$^2$ (or mg/ft$^2$).

Radiographic Material F (Invention):

Material F was like Material D except that antifoggant precursor Compound U was added to the silver halide emulsion layer at 0.22 mg/dm$^2$ (or 2 mg/ft$^2$).

Radiographic Material G (Control):

Radiographic Material G was like Material D except that the nonconductive overcoat and interlayer formulations shown below were used on both sides of the support over the silver halide emulsion layer:

| | Coverage (mg/dm$^2$) |
|---|---|
| Overcoat Formulation | |
| Gelatin vehicle | 1.6 |
| Methyl methacrylate matte beads | 0.27 |
| Carboxymethyl casein | 0.75 |
| Colloidal silica (LUDOX AM) | 1.07 |
| Polyacrylamide | 0.54 |
| Chrome alum | 0.025 |
| Resorcinol | 0.058 |
| Dow Corning polydimethylsiloxane | 0.35 |
| Triton ® XE surfactant (Rohm & Haas) | 0.16 |
| Fluorad FC-124 surfactant (3M Company) | 0.38 |
| Forafac surfactant (3M Company) | 0.016 |
| Interlayer Formulation | |
| Gelatin vehicle | 2.9 |
| AgI Lippmann emulsion (0.08 μm) | 0.11 |
| Carboxymethyl casein | 0.73 |
| Colloidal silica (LUDOX AM) | 1.07 |
| Polyacrylamide | 0.54 |
| Chrome alum | 0.025 |
| Resorcinol | 0.058 |

Radiographic Material H (Invention):

This material was like Material D except that antifoggant precursor Compound U was added to the silver halide emulsion layer at 0.11 mg/dm$^2$ (or 1 mg/ft$^2$).

Radiographic Material I (Invention):

This material was like Material D except that antifoggant precursor Compound U was added to the silver halide emulsion layer at 0.22 mg/dm$^2$ (or 2 mg/ft$^2$).

Samples of Materials D-I were exposed to green light using an inverse square X-ray sensitometer (device that makes exceedingly reproducible X-ray exposures). A lead screw moved the detector between exposures. By use of the inverse square law, distances were selected that produced exposures that differed by 0.100 log E. The length of the exposures was constant.

The exposed samples were processed to provide images in the same manner described in Example 1, and optical densities were similarly determined. The exposed and processed samples were then incubated as described in Example 1, and the results are provided below in TABLE II.

The results indicate that the use of the antifoggant precursor reduces the formation of fog ($D_{min}$) over time in the materials containing the conductive overcoats (Materials E and F vs. Material D). For Materials H and I, there was also an improvement over Material G even though the overcoat was not conductive. Speed loss was greatly minimized with the invention Materials E and F compared to Material D and Materials H and I compared to Material G.

TABLE II

| Radiographic Material | "Fresh" Speed | 1 Week Speed | 2 Week Speed | 4 Week Speed | "Fresh" $D_{min}$ | 1 Week $D_{min}$ | 2 Week $D_{min}$ | 4 Week $D_{min}$ |
|---|---|---|---|---|---|---|---|---|
| D (Control) | 460 | 460 | 446 | 405 | 0.196 | 0.263 | 0.409 | 0.440 |
| E (Invention) | 459 | 459 | 460 | 450 | 0.197 | 0.204 | 0.238 | 0.321 |
| F (Invention) | 458 | 461 | 460 | 455 | 0.194 | 0.210 | 0.212 | 0.248 |
| G (Control) | 460 | 460 | 454 | 417 | 0.197 | 0.212 | 0.333 | 0.421 |
| H (Invention) | 459 | 460 | 463 | 459 | 0.202 | 0.205 | 0.207 | 0.220 |
| I (Invention) | 457 | 458 | 459 | 460 | 0.203 | 0.198 | 0.198 | 0.206 |

The invention has been described in detail with particular reference to preferred embodiments thereof, but it will be understood that variations and modifications can be effected within the spirit and scope of the invention.

The invention claimed is:

1. A black-and-white radiographic material for providing a black-and-white-image comprising a support and disposed on at least one side of said surface, one or more hydrophilic colloid layers including a tabular grain silver halide emulsion layer containing predominantly spectrally sensitized tabular silver halide grains, said silver halide emulsion further comprising at least 0.5 mmol/mol of silver of an amido compound as an antifoggant precursor that slowly releases an antifoggant, that is in reactive association with silver halide in at least one tabular grain silver halide emulsion layer.

2. The material of claim 1 wherein said antifoggant precursor is present in an amount of from about 0.5 to about 4 mmol/mol of total silver of each side of said support.

3. The material of claim 1 wherein said amido compound is represented by the following Structure (I):

(I)

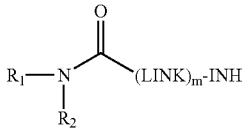

wherein INH is a development inhibitor moiety, LINK is a linking or timing group, m is 0, 1 or 2, and $R_1$ and $R_2$ independently represent an aliphatic, aromatic or heterocyclic group, or $R_1$ and $R_2$ together with the nitrogen to which they are attached represent the atoms necessary to form a 5- or 6-membered ring or multiple ring system, or $R_1$ and $R_2$ are independently a —C(=O)(LINK)$_m$-INH group, or are substituted with an —NR$^{3a}$C(=O)-(LINK)$_m$-INH group, with R$^{3a}$ being defined the same as $R_1$ and $R_2$.

4. The material of claim 3 wherein INH is a mercaptotetrazole.

5. The material of claim 4 wherein INH is a substituted phenyl mercaptotetrazole.

6. The material of claim 1 wherein said amido compound is one or more of the following compounds (D), (L), or (U):

(D)

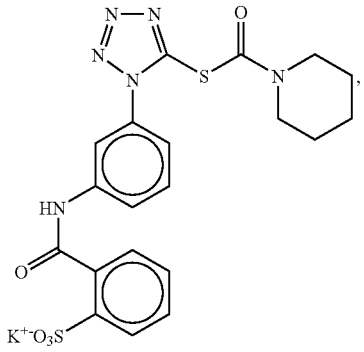

(L)

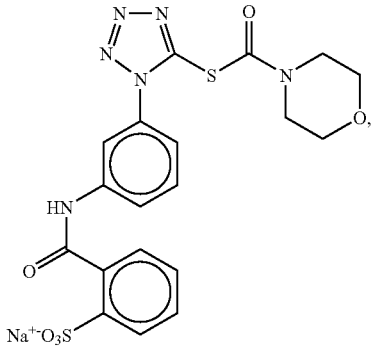

and (U)

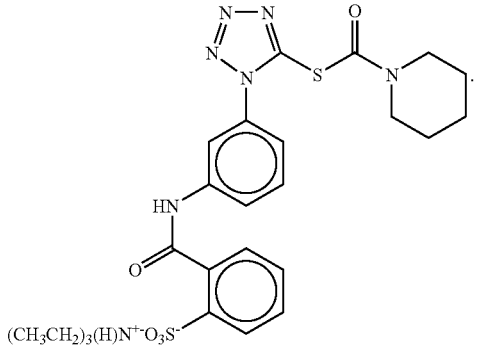

7. The material of claim 1 comprising two or more amido compounds each having a different INH moiety.

8. The material of claim 1 wherein said tabular grain silver halide emulsion layer comprises green-sensitized tabular silver halide grains that have an aspect ratio of at least 30, an average ECD of at least 2.5 μM, an average grain thickness of from about 0.07 to about 0.1 μM, and comprise at least 90 mol % bromide and up to 10 mol % iodide, both based on total silver in said grains.

9. The material of claim 8 wherein said tabular grain silver halide emulsion layer comprises green-sensitized tabular silver halide grains that have an aspect ratio of from about 30 to about 50, an average ECD of from about 2.5 to about 3.5 μm, an average grain thickness of from about 0.07 to about 0.09 μm, and comprise at least 95 mol % bromide and up to 5 mol % iodide, both based on total silver in said grains.

10. The material of claim 1 wherein said tabular grain silver halide emulsion layer comprises blue-sensitized tabular silver halide grains that have an aspect ratio of at least 25, an average ECD of at least 3 μm, an average grain thickness of from about 0.1 to about 0.15 μm, and comprise at least 90 mol % bromide and up to 5 mol % iodide, both based on total silver in said grains.

11. The material of claim 10 wherein said tabular grain silver halide emulsion layer comprises blue-sensitized tabular silver halide grains that have an aspect ratio of from about 25 to about 35, an average ECD of from about 3 to about 3.5 μm, an average grain thickness of from about 0.11 to about 0.14 μm, and comprise at least 95 mol % bromide and up to 5 mol % iodide, both based on total silver in said grains.

12. The material of claim 1 wherein said tabular silver halide grains are green-sensitized and said material has a total silver coverage of at least 15 and up to 18 mg/dm$^2$ on said tabular grain silver halide emulsion side of said support, and a polymer vehicle coverage on said tabular grain emulsion side of said support of from about 28 to about 34 mg/dm$^2$, or said tabular silver halide grains are blue-sensitized and said material has a total silver coverage of at least 17 and up to 20 mg/dm$^2$ on said tabular grain silver halide emulsion side of said support, and a polymer vehicle coverage on said tabular grain emulsion side of said support of from about 28 to about 34 mg/dm$^2$.

13. The material of claim 1 comprising the same or different tabular grain silver halide emulsion layers on both sides of said support.

14. The material of claim 1 said tabular silver halide grains are sensitive to radiation within the range of from about 420 to about 560 nm.

15. The material of claim 1 wherein said tabular silver halide grains are spectrally sensitized with a combination of first and second spectral sensitizing dyes that have maximum J-aggregate absorptions on said tabular silver halide grains of from 380 to 500 nm, wherein the maximum J-aggregate absorption of said first spectral sensitizing dye is from 20 to 50 nm lower in wavelength than the maximum J-aggregate absorption of said second spectral sensitizing dye, the molar ratio of said first spectral sensitizing dye to said second spectral sensitizing dye being from 0.25:1 to 1:1, and said first and second spectral sensitizing dyes being present to provide from 50 to 100% of saturation coverage of said tabular silver halide grains.

16. The material of claim 15 wherein said first spectral sensitizing dye is an anionic benzimidazole-benzoxazole simple cyanine having at least one sulfo or carboxy group in the molecule, and said second spectral sensitizing dye is an anionic benzothiazole—benzothiazole simple cyanine having at least one sulfo or carboxy group in the molecule.

17. The material of claim 16 wherein said first spectral sensitizing dye is a monomethine cyanine dye represented by the following Structure II:

(II)

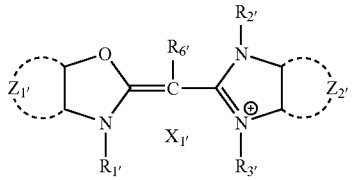

wherein $Z_1'$ and $Z_2'$ represent the carbon atoms necessary to form a substituted or unsubstituted benzene or naphthalene ring, $R_1'$, $R_2'$, and $R_3'$ are independently substituted or unsubstituted alkyl, alkoxy, aryl, or alkenyl groups, $R_6'$ is hydrogen or a substituted or unsubstituted alkyl or phenyl groups, $X_1'$ is an anion or cation as needed, provided that Structure II also comprises at least one sulfo or carboxy group, and said second spectral sensitizing dye is a monomethine cyanine dye represented by the following Structure (III):

(III)

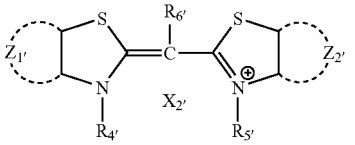

wherein $Z_1'$ and $Z_2'$ represent the carbon atoms necessary to form a substituted or unsubstituted benzene or naphthalene ring, $R_4'$ and $R_5'$ are independently substituted or unsubstituted alkyl, alkoxy, aryl, or alkenyl groups, $R_6'$ is hydrogen or a substituted or unsubstituted alkyl or phenyl group, $X_2'$ is an anion or cation as needed, and provided that Structure III also comprises at least one sulfo or carboxy group.

18. The material of claim 1 further comprising a protective overcoat disposed over said tabular grain silver halide emulsion layer.

19. The material of claim 18 wherein said protective overcoat is a conductive protective overcoat comprising one or more antistatic agents.

20. The material of claim 1 comprising a polymeric support that has first and second major surfaces, said radiographic material having disposed each of said first and second major support surfaces, the same hydrophilic colloid layers including a single tabular grain silver halide emulsion layer, said tabular grain silver halide emulsion layer comprising:

a) green-sensitized tabular silver halide grains that have an aspect ratio of from about 30 to about 40, an average ECD of from about 2.5 to about 3 μm, and an average thickness of from about 0.07 to about 0.09 μm, and comprise at least 95 mol % bromide and up to 5 mol % iodide, both based on total silver in said grains, or b) blue-sensitized tabular silver halide grains that have an aspect ratio of from about 25 to about 30, an average ECD of from about 3 to about 3.5 μm, and an average thickness of from about 0.11 to about 0.14 μm, and comprise at least 95 mol % bromide and up to 5 mol % iodide, both based on total silver in said grains, said material comprising a protective overcoat disposed over all of said hydrophilic colloid layers on both sides of said support, wherein each of said tabular grain silver halide emulsion layers comprises said amido compound at from about 0.5 to about 2 mmol/mol of total silver on each side of said support, said amido compound comprising one or more of the following compounds (D), (L), or (U):

(D)

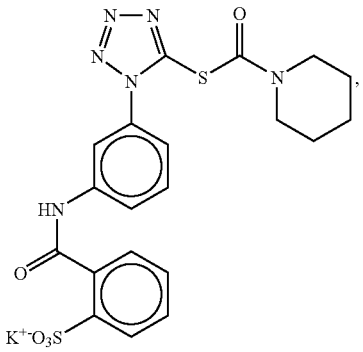

(L)

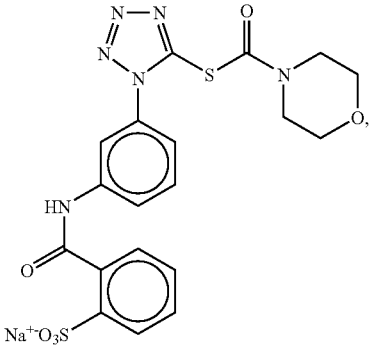

and (U)

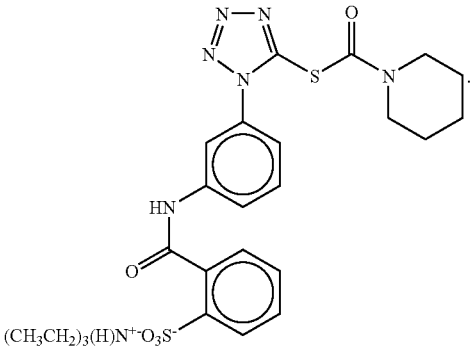

21. The material of claim 20 wherein said tabular grains on each side of said support are green-sensitized and said protective overcoat is a conductive protective overcoat comprising one or more antistatic agents.

22. An imaging assembly comprising:

A) a radiographic material of claim 1, and

B) a fluorescent intensifying screen or storage phosphor panel arranged on the imaging side of said radiographic material, said screen or panel comprising an inorganic phosphor capable of absorbing X-rays and emitting electromagnetic radiation having a wavelength greater than 300 nm, said inorganic phosphor being coated in admixture with a polymeric binder in a phosphor layer on a support.

23. A method of providing a black-and-white image comprising processing an exposed radiographic material of claim 1 to provide a black-and-white image.

24. The material of claim 1 wherein said amido compound is represented by the following Structure (I):

(I)

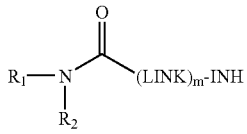

wherein INH is a development inhibitor moiety, LINK is a linking or timing group, m is 0, 1 or 2, and $R_1$ and $R_2$ independently represent an aliphatic or heterocyclic group, or $R_1$ and $R_2$ together with the nitrogen to which they are attached represent the atoms necessary to form a 5- or 6-membered ring or multiple ring system, or $R_1$ and $R_2$ are independently a —C(═O)(LINK)$_m$-INH group, or are substituted with an —NR$^{3a}$C(═O)-(LINK)$_m$-INH group, with R$^{3a}$ being defined the same as $R_1$ and $R_2$.

* * * * *